US007516923B2

(12) United States Patent
Rossini

(10) Patent No.: US 7,516,923 B2
(45) Date of Patent: Apr. 14, 2009

(54) PIVOTING KEYBOARD AND MOUSE TRAY

(75) Inventor: Alfred P. Rossini, Southborough, MA (US)

(73) Assignee: Jaco, Inc., Franklin, MA (US)

( * ) Notice: Subject to any disclaimer, the term of this patent is extended or adjusted under 35 U.S.C. 154(b) by 35 days.

(21) Appl. No.: 11/122,975

(22) Filed: May 5, 2005

(65) Prior Publication Data

US 2005/0247830 A1 Nov. 10, 2005

Related U.S. Application Data

(60) Provisional application No. 60/568,278, filed on May 5, 2004.

(51) Int. Cl.
*B68G 5/00* (2006.01)

(52) U.S. Cl. ..... 248/118; 248/118.3

(58) Field of Classification Search ..... 248/118, 248/118.3

See application file for complete search history.

(56) References Cited

U.S. PATENT DOCUMENTS 4,630,332 A * 12/1986 Bisbing ..... 16/273
5,443,237 A * 8/1995 Stadtmauer ..... 248/441.1
5,667,320 A * 9/1997 Ambrose et al. ..... 400/472
5,704,299 A * 1/1998 Corpuz et al. ..... 108/50.01
5,730,408 A * 3/1998 McAllister et al. ..... 248/288.51
5,791,263 A * 8/1998 Watt et al. ..... 108/138
5,823,487 A * 10/1998 Kirchhoff et al. ..... 248/118
5,927,662 A * 7/1999 West et al. ..... 248/118
5,975,474 A * 11/1999 Kaplan et al. ..... 248/289.11
6,045,098 A * 4/2000 Timm ..... 248/118
6,070,298 A * 6/2000 Sorimachi ..... 16/330
6,079,676 A * 6/2000 Hackett et al. ..... 248/118
6,086,034 A * 7/2000 McAllister et al. ..... 248/278.1
6,098,935 A * 8/2000 Kaplan et al. ..... 348/118.1
6,135,405 A * 10/2000 Jones et al. ..... 248/284.1
6,227,508 B1 * 5/2001 Panzarella et al. ..... 248/276.1
6,279,859 B2 * 8/2001 West et al. ..... 248/118
6,296,215 B1 * 10/2001 McCoy et al. ..... 248/284.1
6,343,775 B1 * 2/2002 Jones et al. ..... 248/284.1
6,390,432 B1 * 5/2002 VanderHeide et al. .. 248/346.01
6,409,127 B1 * 6/2002 VanderHeide et al. ..... 248/118
6,497,391 B1 * 12/2002 Timm ..... 248/118
6,523,797 B2 * 2/2003 LeClair et al. ..... 248/286.1
6,527,235 B1 * 3/2003 Cotterill ..... 248/118.3
6,601,812 B2 * 8/2003 LeClair et al. ..... 248/286.1
6,626,686 B1 * 9/2003 D'Souza et al. ..... 439/131
6,648,282 B1 * 11/2003 Sykes ..... 248/118
6,688,563 B1 * 2/2004 Waxham et al. ..... 248/118.1
6,726,168 B2 * 4/2004 Barber ..... 248/284.1
6,749,158 B2 * 6/2004 Timm ..... 248/118

(Continued)

*Primary Examiner*—J. Allen Shriver, II
*Assistant Examiner*—Bradley H Duckworth
(74) *Attorney, Agent, or Firm*—Brian M. Dingman; Mirick, O'Connell, DeMallie & Lougee, LLP

(57) ABSTRACT

A pivoting keyboard and mouse tray for attachment to a support structure such as a mobile computer cart. The device includes a keyboard tray adapted to hold a keyboard, a mechanical structure for coupling the keyboard tray to the support structure, one or more hinges between the keyboard tray and the mechanical structure to allow the keyboard tray to be pivoted relative to the support structure and maintain the keyboard tray in the pivoted position, and one or more mouse trays integral with or coupled to the keyboard tray.

4 Claims, 5 Drawing Sheets

U.S. PATENT DOCUMENTS 6,874,736 B1 * 4/2005 Jones et al. ..... 248/118
6,877,707 B1 * 4/2005 Jones et al. ..... 248/442.2
7,028,971 B2 * 4/2006 Scott ..... 248/118.1
7,044,425 B2 * 5/2006 Jones et al. ..... 248/442.2
2001/0000616 A1 * 5/2001 West et al. ..... 248/118
2002/0079410 A1 * 6/2002 Kochanski ..... 248/118.1
2002/0158176 A1 * 10/2002 Gilbertson ..... 248/346.01
2004/0178304 A1 * 9/2004 Lando ..... 248/118

* cited by examiner

PIVOTING KEYBOARD AND MOUSE TRAY

CROSS REFERENCE TO RELATED APPLICATION

This application claims priority of Provisional application Ser. No. 60/568,278, filed on May 5, 2004.

FIELD OF THE INVENTION

This invention relates to a keyboard and mouse tray.

BACKGROUND OF THE INVENTION

Mobile carts used as workstations are known. These carts are commonly used in medical facilities and on manufacturing floors. They are typically adapted to carry a computer, and usually have additional shelf space available for the user, for such things as paper work, medications, and/or portable medical equipment. They also may in some cases include a tray that holds a computer keyboard. However, the trays are fixed in both height and angle, thus making them awkward for some users. A more ergonomic design is needed.

SUMMARY OF THE INVENTION

This invention comprises a pivoting tray that holds a keyboard. Retractable, hideaway pivoting extensions on the left- and right-hand sides of the tray hold a mouse-type computer input device. The inventive tray typically is attached to a mobile computer cart that offers a portable computer workstation solution for professionals as well as retail and home use.

This invention features a pivoting keyboard and mouse tray for attachment to a support structure, comprising a keyboard tray adapted to hold a keyboard, a mechanical structure for coupling the keyboard tray to the support structure, one or more hinges between the keyboard tray and such mechanical structure to allow the keyboard tray to be pivoted relative to the support structure and maintain the keyboard tray in the pivoted position, and one or more mouse trays integral with or coupled to the keyboard tray. The hinges may be torque hinges. There may be a plurality of collinear torque hinges. The mechanical structure for coupling the keyboard tray to the support structure may comprise an arm. The arm may comprise flanges on one end for coupling the arm to the support structure. The arm may be generally "L" shaped, with a surface for coupling to the keyboard tray at the distal end of the arm opposite the flanges. One or more hinges may be mounted to the distal end of the arm.

The mouse tray is preferably pivotably coupled to the keyboard tray. The pivoting keyboard and mouse tray may in this case further comprise mechanical structure for guiding the mouse tray in a pivoting path relative to the keyboard tray. The mechanical structure may comprise an arc-shaped slot in one of the keyboard tray and the mouse tray, and a pin that passes through the slot on the other of the keyboard tray and the mouse tray. There may be two mouse trays, one coupled to each end of the keyboard tray, and both coupled in the same pivoting manner. The mouse tray may also comprise a mechanical structure that assists in maintaining a mouse on the mouse tray as the keyboard tray is pivoted, which may comprises an arm proximate the back of the tray, and a tab projecting up from the back of the mouse tray proximate the arm.

This invention also features a pivoting keyboard and mouse tray for attachment to a support structure, comprising a keyboard tray adapted to hold a keyboard, an arm coupled at one end to the support structure at the other end to the keyboard tray, a plurality of torque hinges between the keyboard tray the arm to allow the keyboard tray to be pivoted relative to the arm, and maintain the keyboard tray in the pivoted position, and one or more mouse trays pivotably coupled to the keyboard tray. The arm is preferably generally "L" shaped, with a surface for coupling to the keyboard tray at the distal end of the arm opposite the flanges. The pivoting keyboard and mouse tray may further comprise mechanical structure for guiding each mouse tray in a pivoting path relative to the keyboard tray, which may be accomplished with an arc-shaped slot in one of the keyboard tray and the mouse tray, and a pin that passes through the slot on the other of the keyboard tray and the mouse tray. The mouse trays may each comprise a mechanical structure that assists in maintaining a mouse on the mouse tray as the keyboard tray is pivoted, which may be accomplished with an arm proximate the back of the tray.

BRIEF DESCRIPTION OF THE DRAWINGS

Other objects, features and advantages will occur to those skilled in the art from the following description of the preferred embodiments and the accompanying drawings, in which.

DESCRIPTION OF THE PREFERRED EMBODIMENTS OF THE INVENTION

Figure 1:
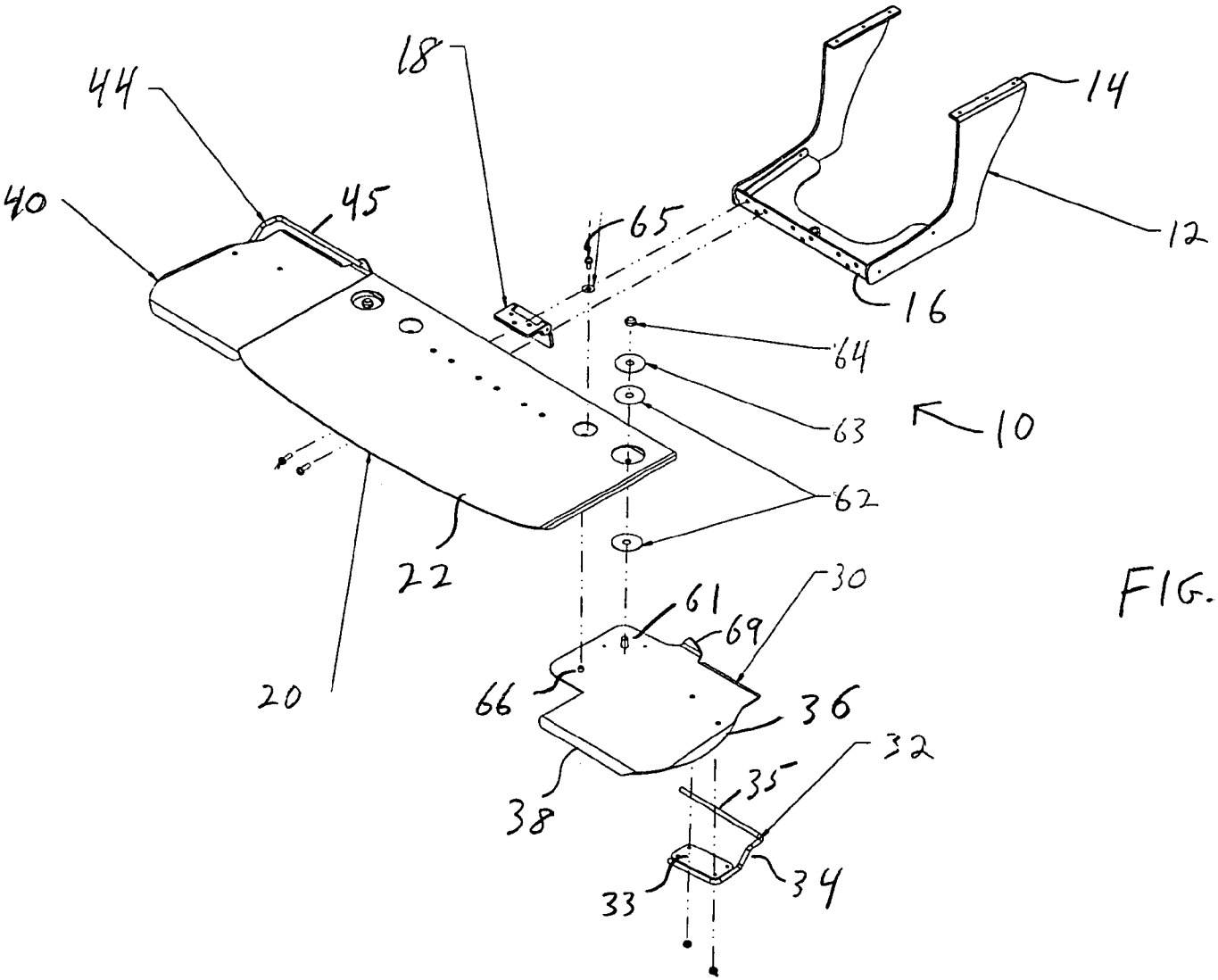
FIG. 1 is a partially disassembled view of the preferred embodiment of the pivoting keyboard and mouse tray of the invention.

This invention may be accomplished in a pivoting keyboard and mouse tray for attachment to a support structure such as a mobile computer cart. The inventive device can be made of steel or aluminum, for example, and preferably includes a keyboard tray adapted to hold a keyboard, a mechanical structure such as an arm for coupling the keyboard tray to the support structure; one or more hinges between the keyboard tray and the mechanical structure to allow the keyboard tray to be pivoted relative to the support structure and maintain the keyboard tray in the pivoted position, and one or more mouse trays integral with or coupled to the keyboard tray.

Pivoting keyboard and mouse tray 10 comprises tray support arm 12, keyboard tray 20, right retractable mouse plate 30, and mirror image left retractable mouse plate 40. Keyboard tray 20 defines upper surface 22 that is sized and shaped to hold a standard keyboard input device and preferably a wrist rest pad. Lower standoff extension 24 provides a surface to which collinear hinges 18 can be mounted without interfering with surface 22. In the preferred embodiment, hinges 18 are torque hinges such as #D 200918 from Reell Precision Manufacturing of St. Paul, Minn. These hinges have enough resistance to maintain the position of the keyboard and mouse plates. Hinges 18 are mounted to the bottom surface of extension 24 and the end face 16 of generally "L"-shaped arm 12.

Figure 4:
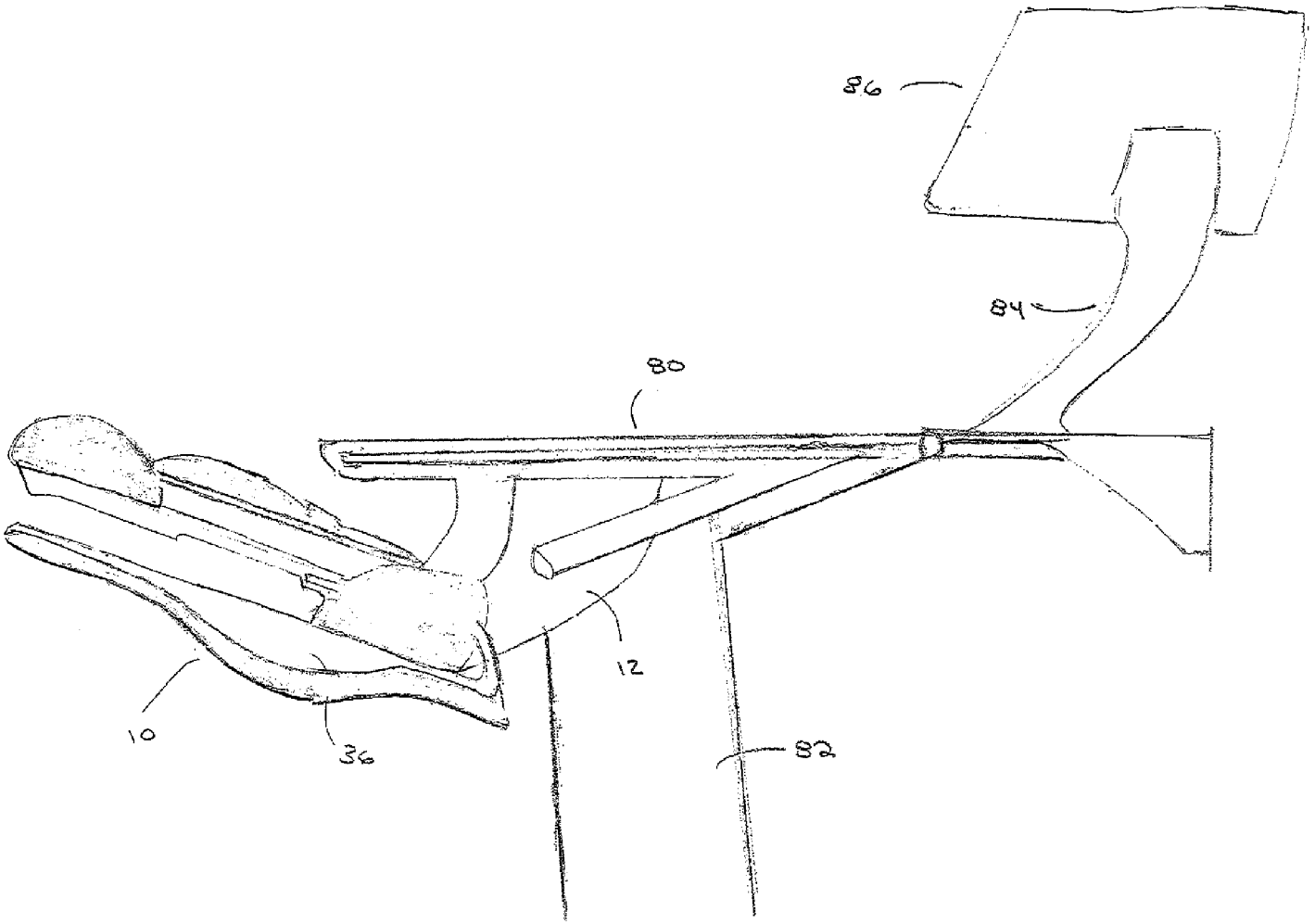
FIG. 4 shows the pivoting keyboard and mouse tray of FIG. 1 mounted to a mobile computer cart.

The other end 14 of arm 12 in this embodiment comprises a flange that is adapted to be mounted to the underside of the upper work surface of a laptop computer tray of a mobile computer cart. This is shown is shown in FIG. 4, in which arm 12 is mounted to the underside of work surface 80 of the mobile computer cart that also comprises adjustable-height post 82 and bracket 84 that holds monitor or tablet computer 86 off of surface 80. An example of an appropriate mobile computer cart on which the inventive tray can be used can be found in U.S. patent application Ser. No. 10/923,638 filed on Aug. 20, 2004, which is incorporated herein by reference.

Hinges 18 allow the positioning of keyboard tray 20 along the entire range of motion of the hinges—in this case from a substantially vertical downward position of tray 20 (in which the keyboard and mouse are out of the way of the user), all the way up through a range of motion beyond horizontal, as shown in FIG. 4. This allows the user to adjust the angle of the keyboard as appropriate depending on the user's position, so that the user can maintain a comfortable position and angle of the keyboard relative to the user's arms. This allows the mobile computer cart to be used by people of different heights in both the seated and standing position. As the mouse plates are attached to the keyboard tray, the mouse is maintained at essentially the same height and in essentially the same plane as the keyboard. This prevents the user from having to bend the wrist at an awkward angle in order to use the mouse.

Figure 2:
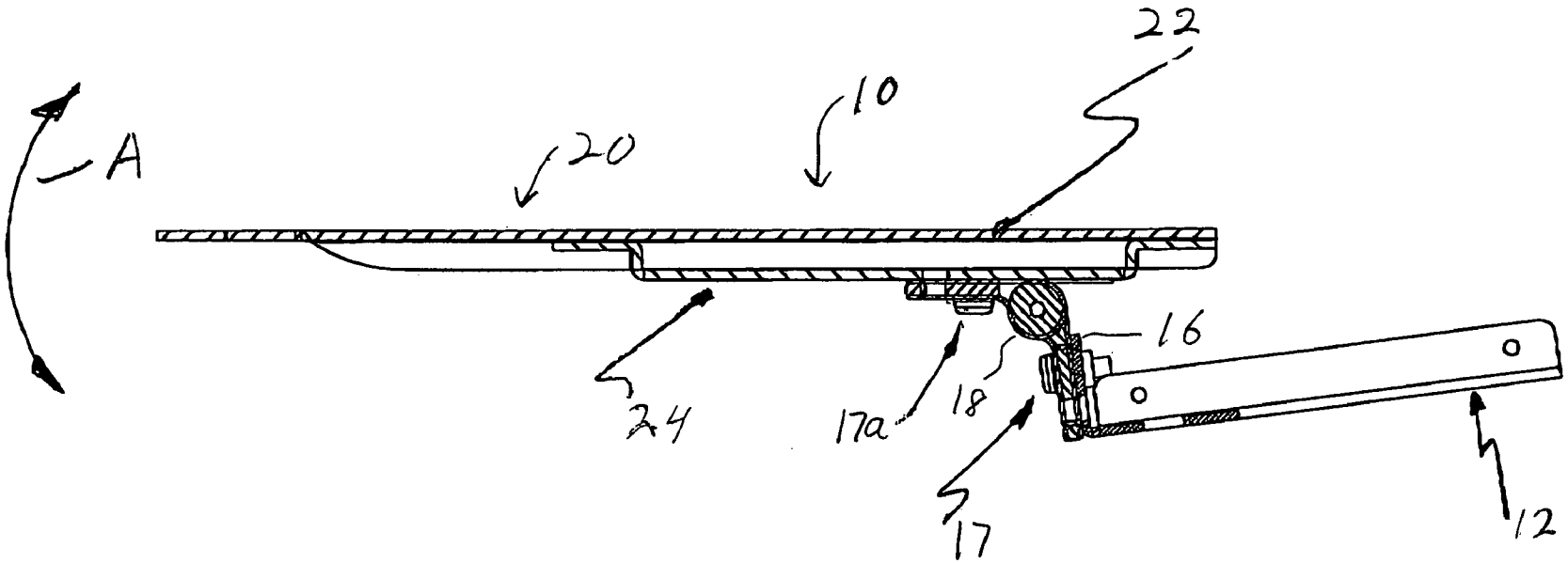
FIG. 2 is a cross-sectional diagram of the assembled pivoting keyboard and mouse tray of FIG. 1.

The right and left mouse plates operate identically. As best seen in FIGS. 1 and 2, right mouse plate 30 is adapted to pivot about projection 61, which can be a bolt and lock nut combination 64, with intermediate washers 62 and 63 that are sandwiched against standoff 24. Extended and retracted positions of the mouse plates are defined by contact of the protruding pin or standoff 66 with the ends of crescent shaped slot 31 formed in lower member 24 in which standoff 66 rides. Standoff 66 can be internally threaded and accept screw 65. The head of the screw rides along the top of slot 31. Screw 65 thus also helps to support the mouse plate in the extended position. Handle 37 provides a grasping point to allow the user to pivot the mouse plate between the extended position such as shown with plate 40, FIG. 1, and a retracted position (not shown in the drawings) in which the plate is stowed under tray 22.

As the mouse trays can be tilted in both directions from the horizontal, it is helpful to include a mechanical structure to maintain the mouse on the mouse plate, while not interfering with the use of the mouse. Front and outside mouse plate edges 38 and 36, respectively, are turned down so that the edges do not interfere with the user's hand. Rear mouse catch rod assembly 32 is attached to mouse plate 30 by screwing the attachment plate 33 to the underside of plate 30. Rod 34 includes extending distal portion 35 that provides a stop at the rear side of the mouse plate, as shown with mirror image rod 45 of left mouse plate 40. This provides some height at the back of the plate so that the mouse does not slide off the back of the plate when the tray is tilted up from the horizontal. In order to help prevent the mouse from sliding off the front of the tray when the tray is pivoted down from the horizontal, rearward upwardly projecting tab 69 is configured to provide a gap between tab 69 and rod distal portion 35, through which the mouse cable can be fitted. This fit helps to prevent the cable from sliding out past the distal end 35 of rod 34, so that the cable stays between rod 34 and plate 30. In this manner, even if the mouse slides off the front 38 or side 36 of plate 30, the cable prevents the mouse from falling to the floor, and the user can grasp the mouse and place it back on plate 30.

Figure 3:
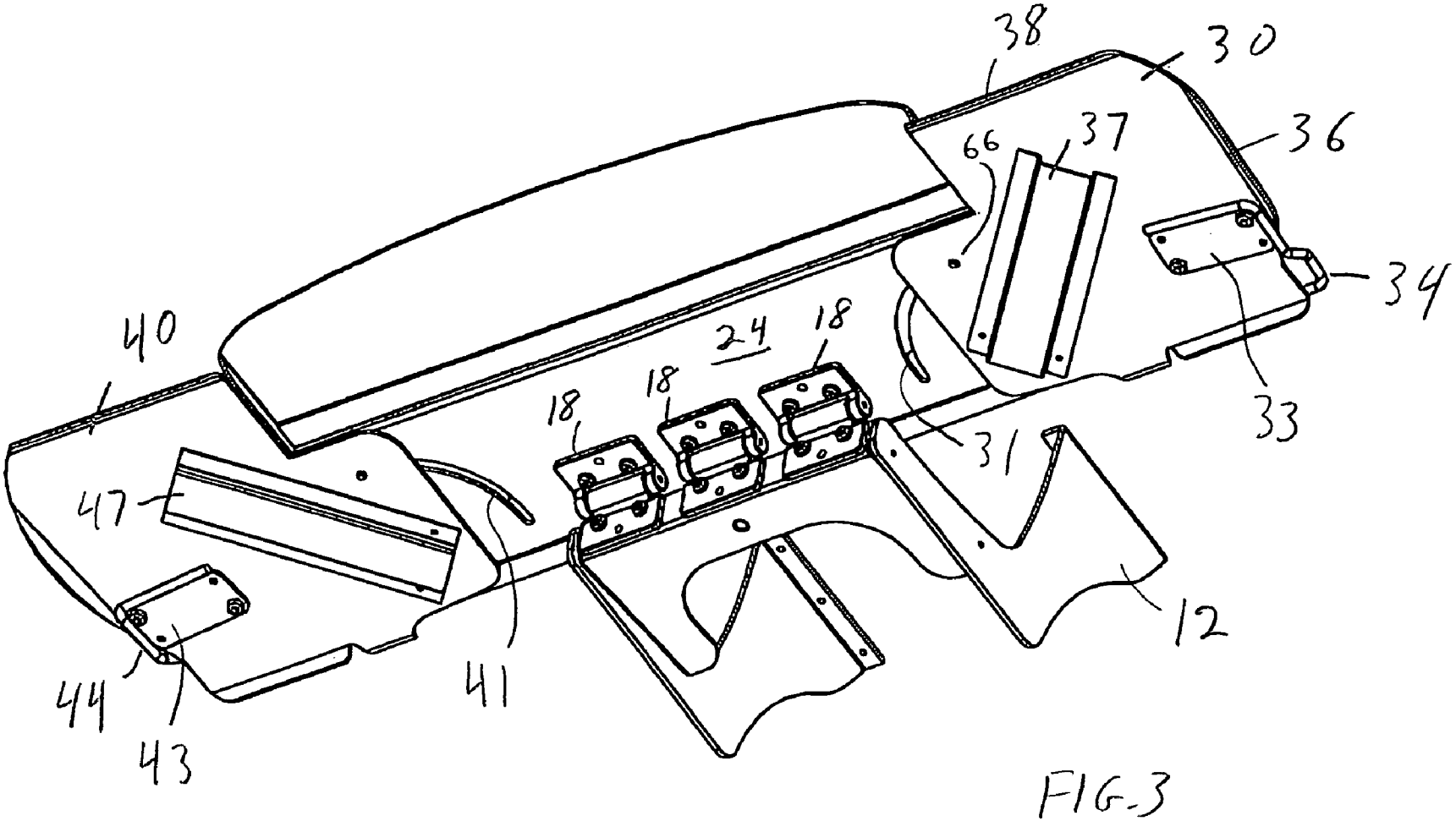
FIG. 3 is a bottom view of the pivoting keyboard and mouse tray of FIG. 1.

Left mouse plate 40 includes handle 47, and attachment plate 43 that carries mouse-retaining rod 44. Slot 41, which mirrors slot 31, is also shown in FIG. 3.

There are alternative means of accomplishing the pivoting keyboard and mouse tray of this invention. For example, there could only be a single mouse plate. The one or two mouse plates need not be retractable relative to the keyboard plate. In fact, the keyboard and mouse trays could be accomplished with a single plate that was sufficiently wide to accommodate a keyboard and mouse. The tray pivot hinge or hinges could be attached directly to the computer cart, without the intermediate tray support arm. Further, the pivoting motion could be accomplished by other means such as a single piano-type hinge, as well as adjustable in-line constant torque hinges that allow an angle to be set and held.

Figure 5:
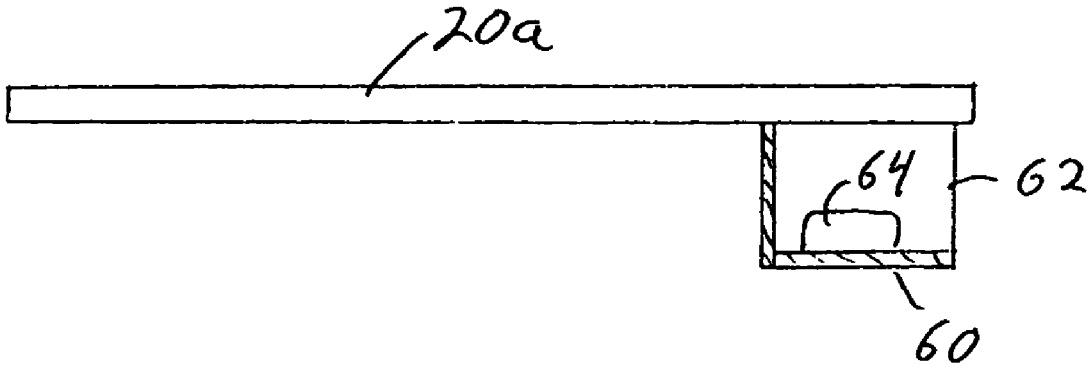
FIG. 5 is schematic, partially cross-sectional drawing of a mouse-retaining pocket for an alternative embodiment of the invention.

Another alternative would be to include a mechanical construction that would store the mouse when the mouse surface is pivoted inward to its stowed position. This could be accomplished with a pocket formed of sheet metal and attached to the bottom of the keyboard or mouse surface. One example is shown in FIG. 5, in which pocket 60 attached to the underside of tray 20*a* has open side 62 into which mouse 64 can be inserted so that the mouse is retained as the tray is moved.

The inventive tray and the cart to which the tray is preferably mounted may be constructed primarily of aluminum and/or cold rolled steel sheet metal. The metal is processed through turret punch machines and lasers to produce the shapes needed. The metal is formed in press brake machines and then a powder coat finish is applied. The finished parts are assembled and tested before shipping. The cart is designed to be used with a variety of computing solutions such as, but not limited to, standard desktop or laptop computers, thin client computers, and all-in-one flat screen computer systems. All computers can be secured to the mobile cart by either a locking cover surface that can be secured by a padlock, or a wrap cable that will prevent removal of the computer while engaged, and in which access to the cable release mechanism is blocked by a padlock.

A computer security device is preferably included. The particular device employed varies depending on the type of computer system that is installed on the cart. For example, a universal CPU holder (typically mounted to the base of the cart, but which can be located where desired) can be used to securely hold thin client and full function CPUs of desktop computer models. The computer can be locked into position on the CPU holder with a nylon coated steel braided wire that crosses over the top of the PC and is held tightly in place with a hold down screw; access to this hold down screw is blocked by inserting a padlock through a structure in front of the hold down screw. To remove the computer, the padlock must be removed, and then the hold down screw loosened, which allows the cable to be loosened and the PC to be removed. Other locking arrangements are possible.

Although specific features of the invention are shown in some drawings and not others, this is for convenience only, as the features can be combined as would be apparent to those skilled in the art, and as the claims set forth the rights granted under the patent. Other combinations of features will be apparent to those skilled in the art and are within the scope of the claims.

What is claimed is:

1. A support structure comprising:

a substantially horizontal work surface comprising a top side, a bottom side, a front edge, a back edge opposite the front edge, and two opposed side edges, and defining a substantially horizontal plane;

a keyboard tray adapted to hold a keyboard and comprising a top side, a bottom side, a front edge, a back edge opposite the front edge, and two opposed side edges;

an extension member comprising a top side, a bottom side, a front edge, a back edge opposite the front edge, and two opposed side edges, wherein the top side of the extension member is coupled to the bottom side of the keyboard tray, and wherein the bottom side of the extension member further comprises two arc-shaped slots, a first arc-shaped slot located below and proximate one of the side edges of the keyboard tray and a second arc-shaped slot located below and proximate the opposed side edge of the keyboard tray;

an arm comprising first and second side members, an edge member, and a pair of flanges, wherein each of the side members is each generally "L" shaped and comprise a first end and a second end, and wherein the side members are spaced apart and generally parallel to each other, and wherein the first ends of the side members are each coupled to one end of the edge member and the second ends of the side members are each coupled to one of the flanges, and wherein the flanges are fixedly and non-pivotably coupled to the bottom side of the work surface, so as to position the keyboard tray in a substantially horizontal plane below the substantially horizontal plane defined by the work surface;

one or more collinear torque hinges coupled to the bottom side of the extension member at a location proximate the back edge of the keyboard tray, the one or more hinges having sufficient resistance to maintain the position of the keyboard tray and allow the keyboard tray to pivot relative to the edge member of the arm along a range of motion from a substantially vertical downward position relative to the support structure up to a position beyond horizontal relative to the support structure, wherein the extension member is adapted to couple the one or more hinges to the keyboard tray without interfering with the top side of the keyboard tray; and two mouse trays, a first mouse tray coupled to the bottom side of the extension member proximate one of the side edges of the keyboard tray and a second mouse tray coupled to the bottom side of the extension member proximate the opposed side edge of the keyboard tray, each mouse tray having a top side, a bottom side, a front edge, a back edge opposite the front edge, and two opposed side edges, wherein each of the mouse trays further comprises a projection located on the top side of the mouse tray and proximate the side edge of the mouse tray closest to the keyboard tray and adapted to couple the mouse tray to the extension member, and a pin located on the top side of the mouse tray proximate the side edge of the mouse tray closest to the keyboard tray and adapted to ride in the arc-shaped slot in the extension member, wherein each of the mouse trays is adapted to pivot relative to the keyboard tray about the projection from a retracted position where the mouse tray is stowed under the keyboard tray through to an extended position where the front edge of the mouse tray is generally parallel to the front edge of the keyboard tray, and wherein the extended and retracted positions of each mouse tray are defined by contact of the pin with the ends of one of the arc-shaped slots.

2. The support structure of claim 1, wherein each mouse tray further comprises a rod assembly coupled to the bottom side of the mouse tray, wherein the rod assembly comprises a rod having a distal portion proximate the back edge of the mouse tray and adapted to assist in maintaining a mouse on the mouse tray.

3. The support structure of claim 2, wherein each mouse tray further comprises a tab projecting up from the back edge of the mouse tray and adapted to form a gap between the tab and the distal portion of the rod to assist in positioning a cable coupled to the mouse.

4. The support structure of claim 1, further comprising a handle located on the bottom side of the mouse tray and adapted to provide a grasping point for pivoting the mouse tray between the extended and retracted positions.

* * * * *